US006582285B2

(12) United States Patent
Czekai et al.

(10) Patent No.: US 6,582,285 B2
(45) Date of Patent: Jun. 24, 2003

(54) APPARATUS FOR SANITARY WET MILLING

(75) Inventors: David A. Czekai, Spring City; Robert G. Reed, Birdsboro, both of PA (US)

(73) Assignee: Elan PharmaInternational Ltd, County Clare (IE)

( * ) Notice: Subject to any disclaimer, the term of this patent is extended or adjusted under 35 U.S.C. 154(b) by 0 days.

(21) Appl. No.: 09/842,619

(22) Filed: Apr. 26, 2001

(65) Prior Publication Data

US 2001/0053664 A1 Dec. 20, 2001

Related U.S. Application Data

(60) Provisional application No. 60/199,923, filed on Apr. 26, 2000.

(51) Int. Cl.[7] ..... B24C 3/26
(52) U.S. Cl. ..... 451/85; 451/39; 451/82
(58) Field of Search ..... 451/38, 39, 82, 451/85, 87–89, 2

(56) References Cited

U.S. PATENT DOCUMENTS

| | | | | |
|---|---|---|---|---|
| 3,943,668 A | * | 3/1976 | McKibben | 451/327 |
| 4,624,418 A | | 11/1986 | Szkaradek | 241/46.17 |
| 4,784,336 A | | 11/1988 | Lu | 241/65 |
| 4,848,676 A | | 7/1989 | Stehr | 241/33 |
| 5,024,387 A | | 6/1991 | Yeh | 241/21 |
| 5,560,743 A | * | 10/1996 | Imayama et al. | 451/2 |
| 5,593,097 A | | 1/1997 | Corbin | 241/21 |
| 5,718,388 A | | 2/1998 | Czekai et al. | 241/21 |
| 5,791,569 A | | 8/1998 | Ishikawa | 241/74 |
| 5,797,550 A | | 8/1998 | Woodall et al. | 241/171 |
| 5,853,132 A | | 12/1998 | Tsuji | 241/172 |
| 5,862,999 A | | 1/1999 | Czekai et al. | 241/21 |
| 5,882,246 A | | 3/1999 | Inkyo et al. | 451/87 |
| 5,947,796 A | * | 9/1999 | Imayama et al. | 451/2 |

* cited by examiner

*Primary Examiner*—Joseph J. Hail, III
*Assistant Examiner*—David B. Thomas

(57) ABSTRACT

Improved cleanability and contamination prevention are provided in a wet milling apparatus for the production of pharmaceutical grade milled products. The advantages are provided by a milling agitator that is characterized by a smooth, seamless agitating surface, without crevices or seams which might accumulate contamination and which might prevent removal of contamination during cleaning. The use of polymeric milling media reduces wear on the agitator and permits the agitator to be constructed with permanent, smooth welded joints. Seamless joints are also provided on the interior of the milling chamber and sanitary, threadless fasteners are provided for the media separation screen and other milling chamber fittings.

19 Claims, 10 Drawing Sheets

APPARATUS FOR SANITARY WET MILLING

This application claims the benefit of provisional application 60/199,923 filed Apr. 26, 2000.

TECHNICAL FIELD

The invention relates generally to wet milling apparatus for the production of fine grade particulate substances. More specifically, the invention relates to wet milling apparatus that are suitable for the production of pharmaceutical grade substances.

BACKGROUND OF THE INVENTION AND TECHNICAL PROBLEMS POSED BY THE PRIOR ART

It is known that the rate of dissolution and therefore the bioavailability of a particulate drug can be increased by increasing surface area, i.e., decreasing particle size. Consequently, efforts have focused on methods of manufacturing finely divided particulate pharmaceutical compositions. Wet milling techniques are recognized in the production of a wide variety of fine, particulate compositions. For example, wet milling techniques are disclosed in U.S. Pat. No. 5,882,246 issued to Inkyo; U.S. Pat. No. 5,853,132 issued to Tsuji; U.S. Pat. No. 5,797,550 issued to Woodall, et al.; U.S. Pat. No. 5,791,569 issued to Ishikawa; U.S. Pat. No. 5,718,388 issued to Czekai, et al.; U.S. Pat. No. 5,593,097 issued to Corbin; U.S. Pat. No. 5,024,387 issued to Yeh; U.S. Pat. No. 4,848,676 issued to Stehr; U.S. Pat. No. 4,784,336 issued to Lu; and U.S. Pat. No. 4,624,418 issued to Szkaradek. These media mills typically include a cylindrical vessel housing a vertically or horizontally mounted agitator shaft having shear members extending therefrom. Typically, a dispersion consisting of the product to be milled and a grinding media is introduced into the vessel. Rotating the agitator causes the media to nib and shear the product into a finer grade. Since the agitator shear members are prone to excessive wear, there is widespread teaching in the prior art that they are advantageously secured to the agitator shaft using removable fasteners.

The prior art has recognized the applicability of wet milling techniques to the production of pharmaceuticals. For example, U.S. Pat. No. 5,862,999 to Czekai et al discloses the use of polymeric milling media in the production of submicron particles of a therapeutic or diagnostic agent. The use of such milling media is disclosed as advantageous in producing therapeutic and diagnostic agents that are free from contamination, due to the resistance of the polymeric media to wear or attrition.

It is desirable for pharmaceutical grade milling apparatus to be adapted for cleaning-in-place, a term that refers to cleaning and sterilization of the apparatus without disassembly and without movement of the apparatus. Typically, the apparatus is flushed with a biocompatible detergent to remove contamination or residue.

While wet milling techniques have been recognized as applicable to pharmaceutical production applications, they have not been widely adopted because known devices have not been recognized as suitable to achieve the contamination prevention and cleaning characteristics that are required of pharmaceutical grade production equipment. For example, the agitator shear member fastening techniques of the prior art have been are characterized by exposed threads, seams or crevices in the area where the shear members are fastened to the agitator shaft. In addition, the milling chamber and fittings used to secure various features therein have not heretofore been developed with attention to reducing contamination risk and improving cleanability and therefore render the milling chamber difficult to clean and prone to contamination. Typically, for example, in prior art commercial milling apparatus, non-sanitary threaded connections are used to secure components, such as the milling chamber floor and media separator screen, within the milling chamber. These characteristics of prior art milling devices present an obstacle to achieving the cleaning and contamination prevention requirements of pharmaceutical grade production equipment. It would therefore be desirable to provide a wet milling apparatus which eliminates these disadvantages.

SUMMARY OF THE INVENTION

The benefits and advantages described above are realized by the present invention which provides a wet milling apparatus that provides improved cleanability and which reduces the risk of contamination to milled compounds. The advantages are provided by an agitator which is characterized by a smooth, seamless pharmaceutical contact surface, without crevices or seams which might accumulate contamination and which might prevent removal of contamination during cleaning.

Applicants have discovered, contrary to the teachings of the prior art, that it is possible to permanently affix the agitator shear members to the agitator shaft using seamless joints, for example, polished welds, to provide a seamless agitating surface that enhances the cleanability of the agitator. Applicants have also discovered that such an agitator configuration is economically feasible and provides desirable milling characteristics when used with polymeric milling media. The welding joints formed between the agitator shaft and the projections may be finished as smooth, seamless surfaces, with no areas, such as seams or exposed thread joints, which permit the accumulation of pharmaceutical product or contamination. The agitator may therefore be cleaned and sterilized easily and without disassembly. An exemplary agitator according to the invention, has a plurality of pegs extending from a cylindrical agitator shaft. The pegs are welded to the agitator and the welds are ground smoothly and polished so that the peg and agitator surfaces form a seamless or continuous agitating surface.

In another exemplary embodiment, the agitator shaft is provided without shear members, but with a smooth, seamless cylindrical surface. The diameter of the agitator shaft is increased to provide a narrow annular clearance between the agitator shaft and the cylindrical milling chamber wall. In combination with appropriate milling media materials and sizes, desirable milling characteristics are achieved by the interaction of the milling media with the product in the narrow annular clearance. Moreover, the smooth surface of the agitator provides improved cleaning and contamination prevention characteristics.

According to another feature of the invention, the cleanability and contamination prevention features of a milling apparatus are improved through the use of seamless joints on the interior surface of the milling chamber. In an exemplary embodiment, a milling apparatus is provided with a milling chamber with a welded construction, the welds being polished to provide a smooth, seamless interior surface on the milling chamber, thereby enhancing the cleanability of the milling chamber and reducing or eliminating areas which might harbor bacteria or other contamination.

According to yet another feature of the invention, sanitary fasteners are provided for securing the media separation screen within the milling chamber. In a preferred embodiment, a threadless, sanitary, tool-free clamping fastener is provided for securing the product outlet housing, which includes the media separation screen fastened thereto, to the milling chamber wall.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described. The scope of the invention is pointed out in the appended claims.

Figure 1:
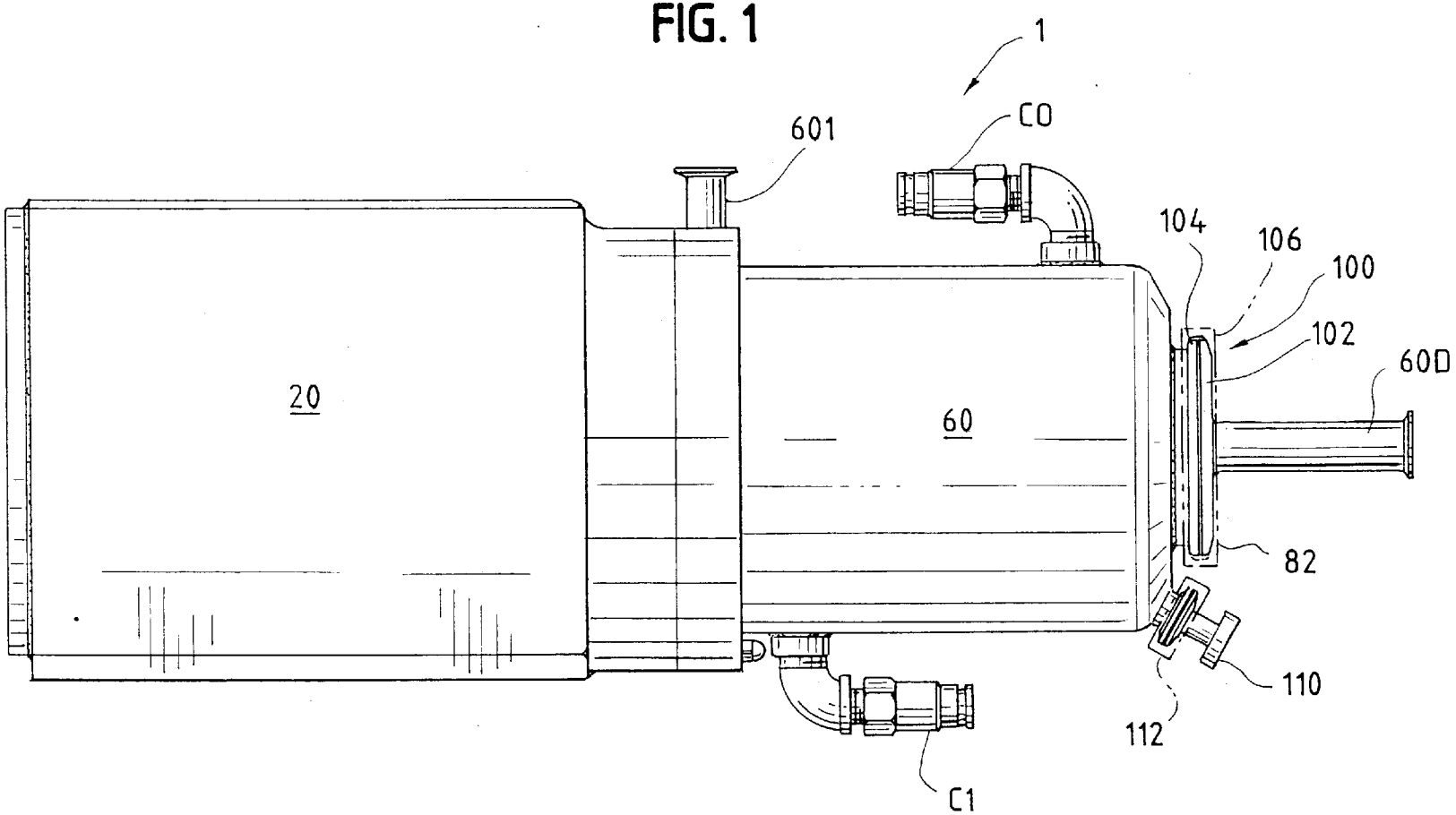
FIG. 1 illustrates a media mill according to the present invention.

A plan view of an exemplary wet media mill 1 according to the present invention is illustrated in FIG. 1. The exemplary wet media mill 1 generally comprises a drive housing 20 and a milling chamber housing 60. A product inlet 60I provides for ingress of the product to the interior of the milling chamber housing 60 and a product outlet 60D conducts milled product from the interior of the milling chamber housing 60. A pump (not shown) provides the motive force for moving product from the product inlet 60I, through the mill 1 to the product outlet 60D. A coolant inlet CI and a coolant outlet CO provide for the circulation of coolant, such as water, through the milling chamber housing 60 in conjunction with a coolant supply and coolant pump, both omitted from FIG. 1 for clarity.

As will be described in more detail below, product outlet housing 82 is secured to the milling chamber housing 60 using a sanitary, tool-free clamp 100. The product outlet housing is provided with a first clamping flange 102 which engages a second clamping flange 104 formed on the milling chamber housing 60. A clamping band 106 extends around and receives an outer peripheral portion of the first and second clamping flanges 102 and 104. Similarly, a drain plug 110 is secured to the mill chamber housing 60 with a sanitary, tool-free clamp 112. As will be explained, these features provide for enhanced cleanability and ease of assembly and disassembly according to the objectives of the invention.

Figure 2:
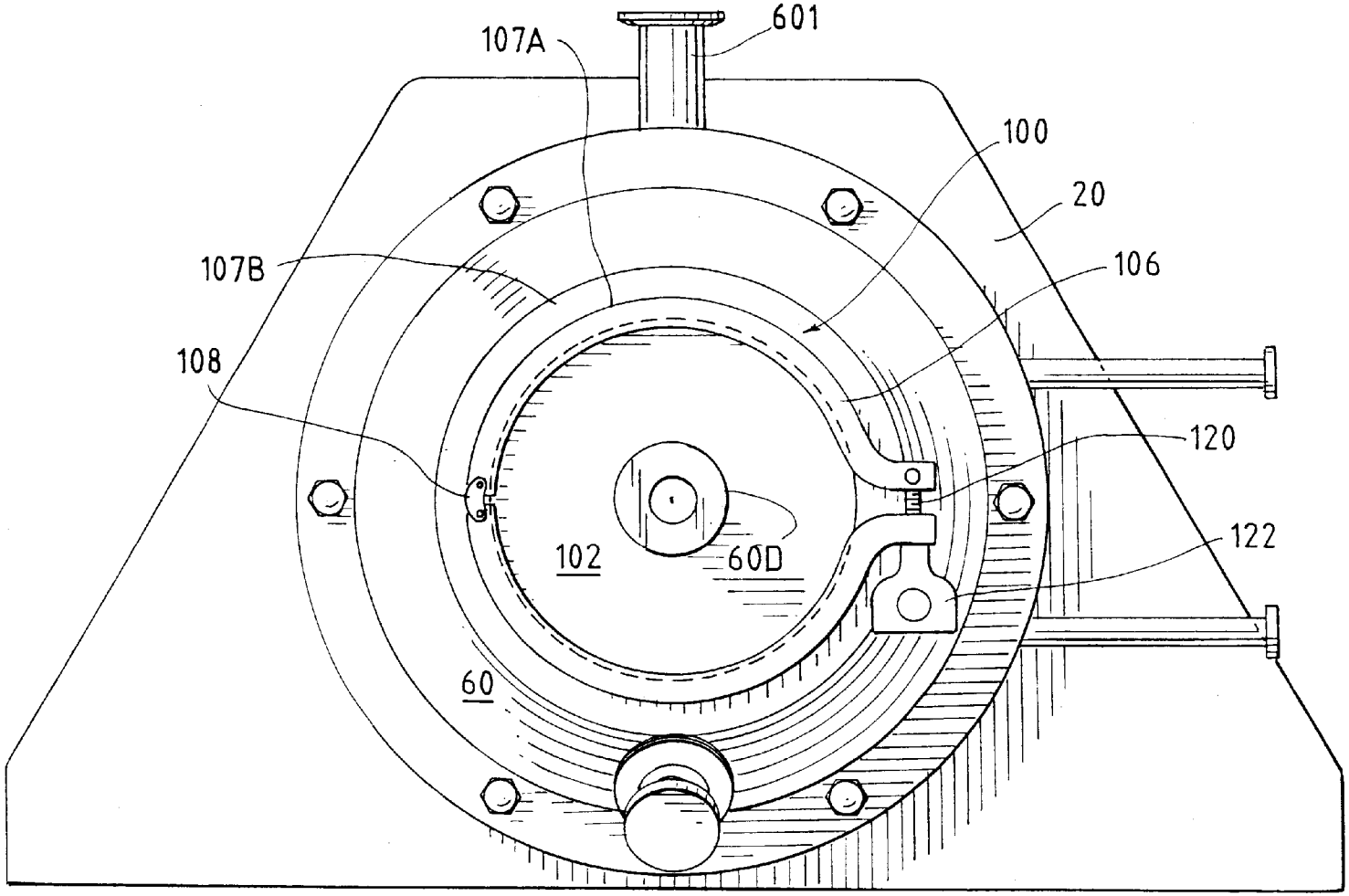
FIG. 2 is a right end view of the media mill of FIG. 1.
Figure 15:
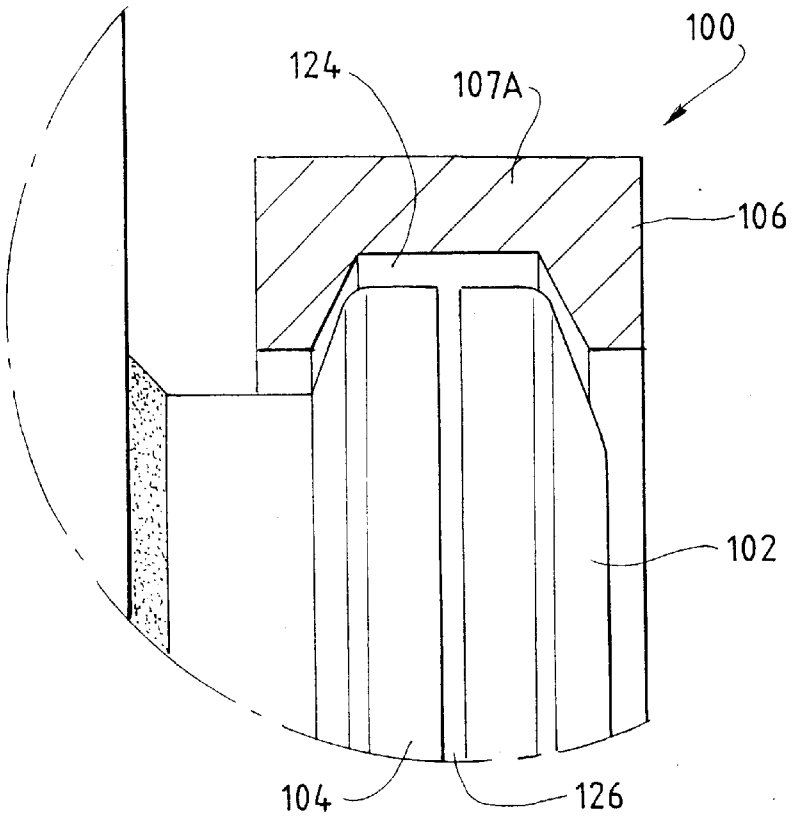
FIG. 15 is a magnified view showing a sanitary clamp for securing the product outlet housing to the milling chamber wall according to a preferred embodiment of the invention.

As illustrated in FIG. 2, the drive shaft housing 20 in this exemplary embodiment is of a general parallelogram shape, while the milling chamber housing 60 is of a generally cylindrical shape, with the product outlet 60D being located centrally with respect to the cylindrical shape of the milling chamber housing 60. FIG. 2 also illustrates a front view of a sanitary, tool-free clamp 100 for securing the product outlet housing 82 to the milling chamber housing 60. In this exemplary embodiment, the clamping band 106 is comprised of a pair of semi-circular bands 107A and 107B, both pivotably connected to a pivot member 108 at one of their ends. The opposite ends of semi-circular bands 107A and 107B are secured with a threaded fastener 120 provided with a handle 122 to permit tool-free, i.e., manual or by hand, operation thereof. Referring additionally to FIG. 15, semi-circular bands 107A and 107B are formed with a channel 124 (shown in dotted lines in FIG. 2) for accomodating the radial peripheries of the first clamping flange 102 and second clamping flange 104. Owing to the shape of channel 124 and the shapes of the peripheries of the first and second clamping flanges (for example, angled surfaces are shown on each), as the semi-circular bands 107A and 107B are clamped toward one another by the threaded fastener 120, the radius of the circle defined by the bands tends to become smaller (band 107A moves downward in FIG. 15) and the first and second clamping flanges 102 and 104 are forced toward one another. A gasket 126 is preferably provided between the clamping flanges to ensure an adequate seal.

Figure 3:
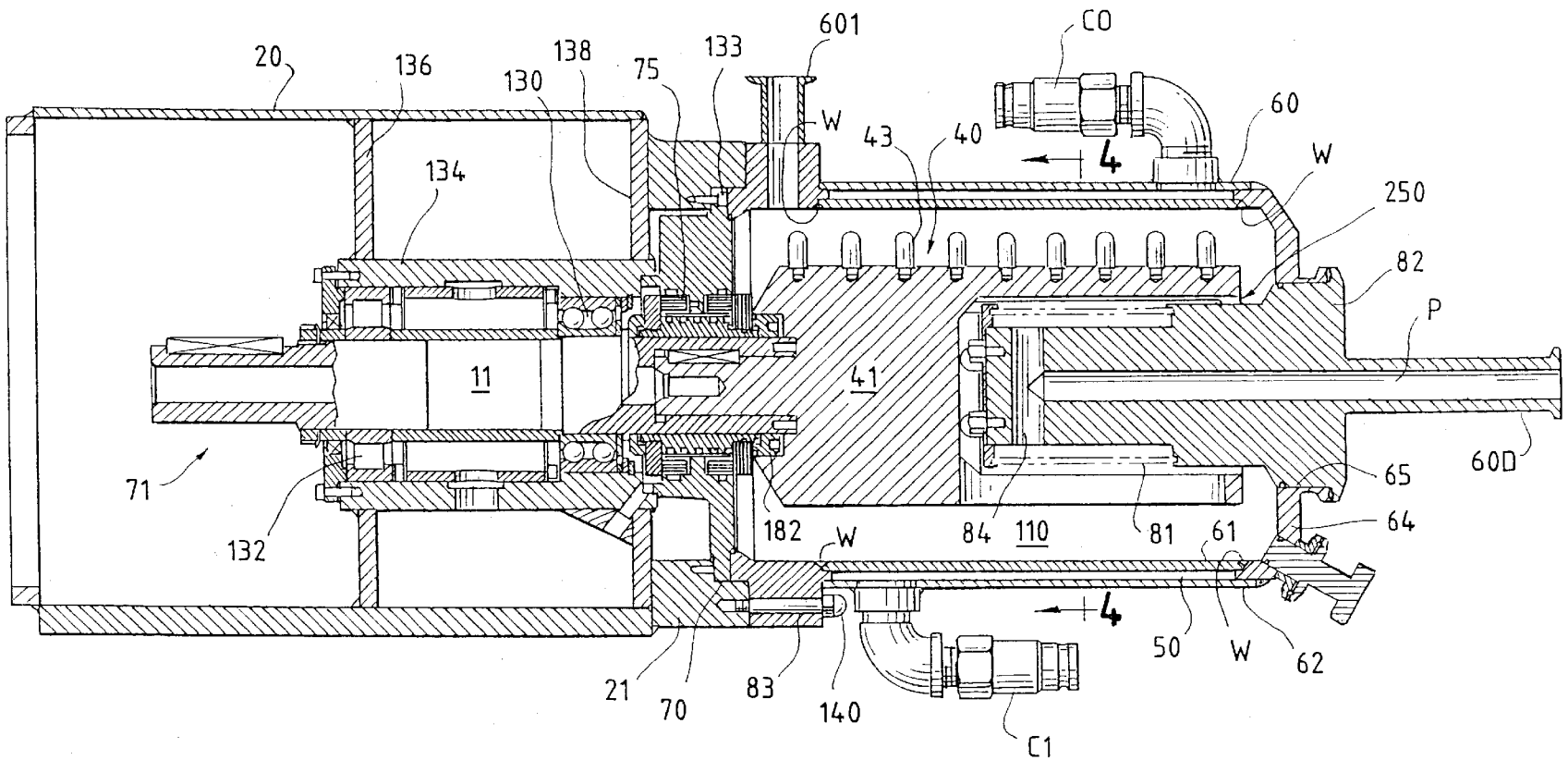
FIG. 3 is a cross-sectional view of the media mill of FIG. 1 taken along its axis.

Referring additionally to FIG. 3, the milling chamber housing 60 is provided with a jacketed or double-walled configuration to allow circulation of coolant, e.g., water in an outer cooling passage 50. The cooling passage 50 is formed by an inner cylindrical wall 61 and an outer cylindrical wall 62. The inner wall 61 and outer wall 62 are fixedly secured, for example, by welding, to a first annular mounting flange 63 and a second annular mounting 64. In accordance with the invention, the product inlet 60I may include a passage formed in the first annular mounting flange 63, or, alternatively, in an additional separate flange. The interior surface of the inner cylindrical wall 61 of the milling chamber housing 60 partially defines a milling chamber 110. In accordance with a primary feature of the invention, the exposed welds (W) within the milling chamber 110 are preferably ground and polished to provide a pharmaceutical grade seamless joint on the interior of the milling chamber 110. The coolant inlet CI provides for ingress of coolant to the cooling passage from an outside source (not shown) and a coolant outlet CO provides for egress of coolant from the cooling passage 50.

An agitator 40 is disposed within the milling chamber 110 and supported on a drive shaft 11 which extends through a mechanical seal assembly 75 and is rotatably supported in a bearing assembly 71. The agitator 40 includes a generally cylindrical agitator shaft 41 from which extends a plurality of shear members, for example, pegs 43 for interacting with milling media in the milling chamber 110. The drive shaft 11 mates with a small diameter portion of the agitator 40. Motive force for rotating the agitator is provided by an electric motor (not shown) which is coupled to the drive shaft 11. The bearing assembly 71 includes a ball bearing assembly 130 and a roller bearing assembly 132, both rotatably supporting the drive shaft 11 and both housed within a cylindrical support 134 secured to the drive housing 20 by annular ribs 136 and 138. The mechanical seal assembly 75 is mounted within a seal support flange 70 and preferably includes appropriate sealing implements for isolating the bearing assembly 75 from the milling chamber 110 and preventing contamination from entering the milling chamber 110. Threaded fasteners 133 secure the seal support flange 70 to a generally cylindrical spacer ring 21 which extends from the drive housing 20. The first mounting flange 63 is also secured to the spacer ring 21 via threaded fasteners 140. As will be recognized by those of ordinary skill, assembly of the mill 1 proceeds by first fastening the seal support flange 70 to the spacer ring 21, securing the agitator 40 to the drive shaft 11 and then securing the first mounting flange 63 and thus the milling chamber housing 60 to the spacer ring 21. In order to permit passage of the assembled agitator into the milling chamber housing 60, the first mounting flange 63 is provided with a through hole which is large enough to permit passage of the agitator 40.

Figure 13:
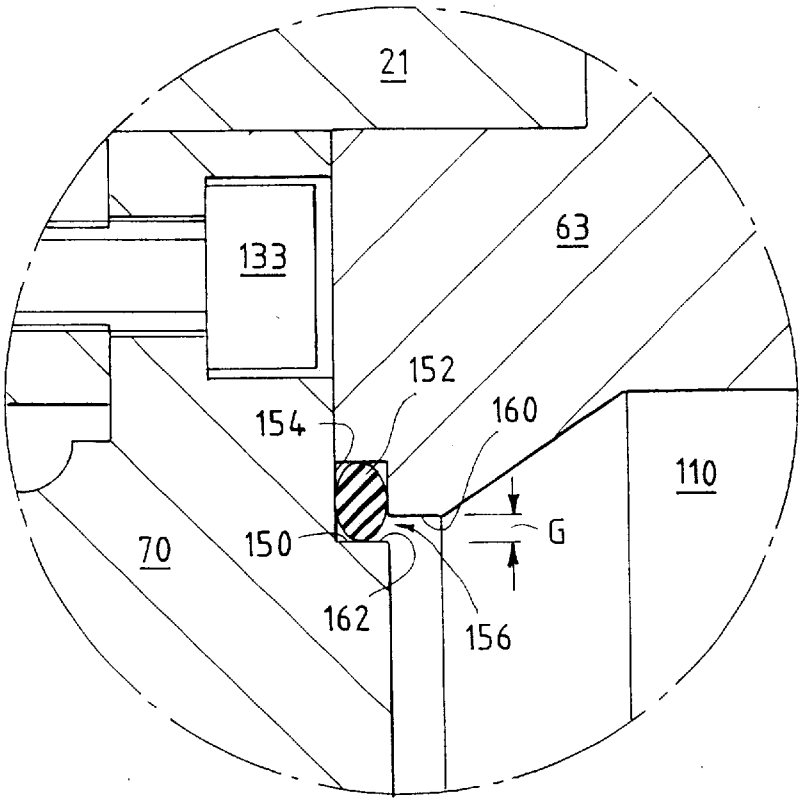
FIG. 13 is a magnified view showing a sanitary sealing interface between a mechanical seal housing and a mounting flange forming a part of a milling chamber according to a preferred embodiment of the invention.

Referring additionally to FIG. 13, in accordance with a primary feature of the invention, a sanitary sealing interface is provided between the seal support flange 70 and the first mounting flange 63 to provide for improved cleanability and contamination prevention within the milling chamber 110. The seal support flange 70 is provided with a first sealing shoulder 150. The first mounting flange 63 is provided with a second sealing shoulder 152. Together, the first sealing shoulder 150 and the second sealing shoulder 152 define an O-ring space for receiving an O-ring 154. In accordance with the invention, the O-ring space is configured to provide an exposed O-ring surface 156 facing the milling chamber 110 for improved cleanability. In addition, a gap (G) is provided between an annular interior surface 160 of the first mounting flange 63 and an annular exterior surface 162 of the seal support flange 70 to permit ingress and egress of cleaning fluids which might be used to clean the milling chamber 110. In contrast to prior art sealing configurations, which utilize isolated O-ring seals to protect them from the abrasive tendencies of conventional milling media and products, the O-ring configuration provided by the invention is not entirely isolated from the milling chamber 110 but has a surface exposed to the milling media and product dispersion. The dimensions of the gap (G) and the extent of the exposed surface of the O-ring are selected to prevent the accumulation of leftover pharmaceutical products and other contaminants in the sealing interface and provide for the exposure of cleaning fluids to the O-ring surface and gap (G).

Figure 14:
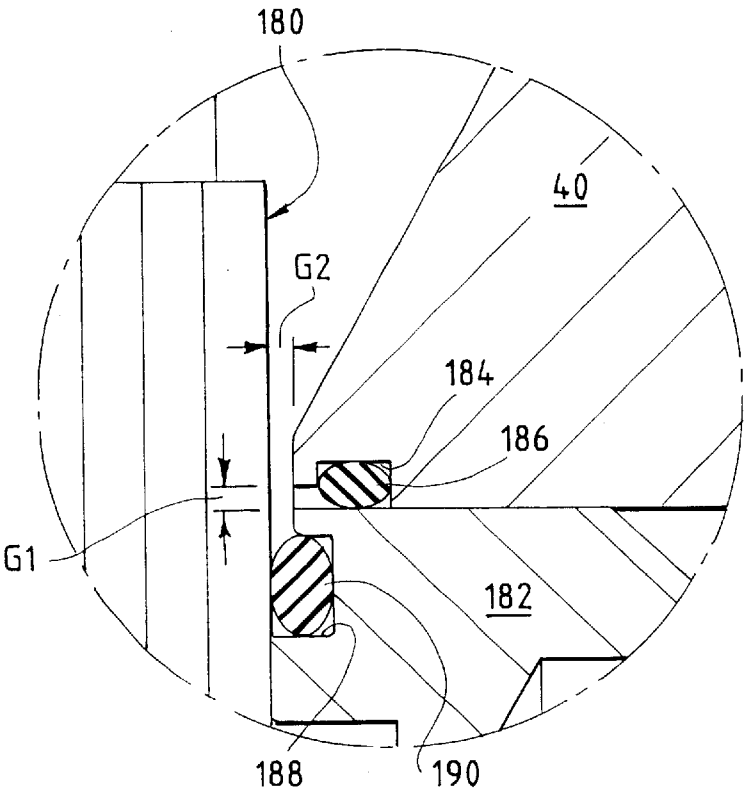
FIG. 14 is a magnified view showing a sanitary sealing interface between an agitator and a mechanical seal according to a preferred embodiment of the invention.

In accordance with the invention, sanitary sealing interfaces are provided at other locations in the milling chamber 110, namely at the interface between the agitator 40 and the mechanical seal assembly 75 and at the interface between the product outlet housing 82 (FIG. 1) and the milling chamber housing 60. Referring to FIG. 14 and again to FIG. 3, a sanitary sealing interface is provided to prevent contamination and provide improved cleanability at the interface where the agitator 40 meets the mechanical seal assembly 75. The mechanical seal assembly 75 includes a seal face 180 which rotates with the agitator 40 relative to the milling chamber 110. A locknut 182 secures the seal to the internal rotating bearing shaft of the mechanical seal assembly 75. The locknut 182, agitator 40 and seal face 180 all rotate together. The agitator 40 is provided with an internal O-ring channel 184 which houses an agitator O-ring 186 and which is provided with an annular gap (G1) to expose a portion of the surface of O-ring 186 to the milling chamber 110 and therefore to cleaning agents. Similarly, the locknut 182 is provided with an O-ring channel 188 accommodating a locknut O-ring 190. A gap (G2) is provided to expose a portion of the surface of O-ring 190.

Figure 4:
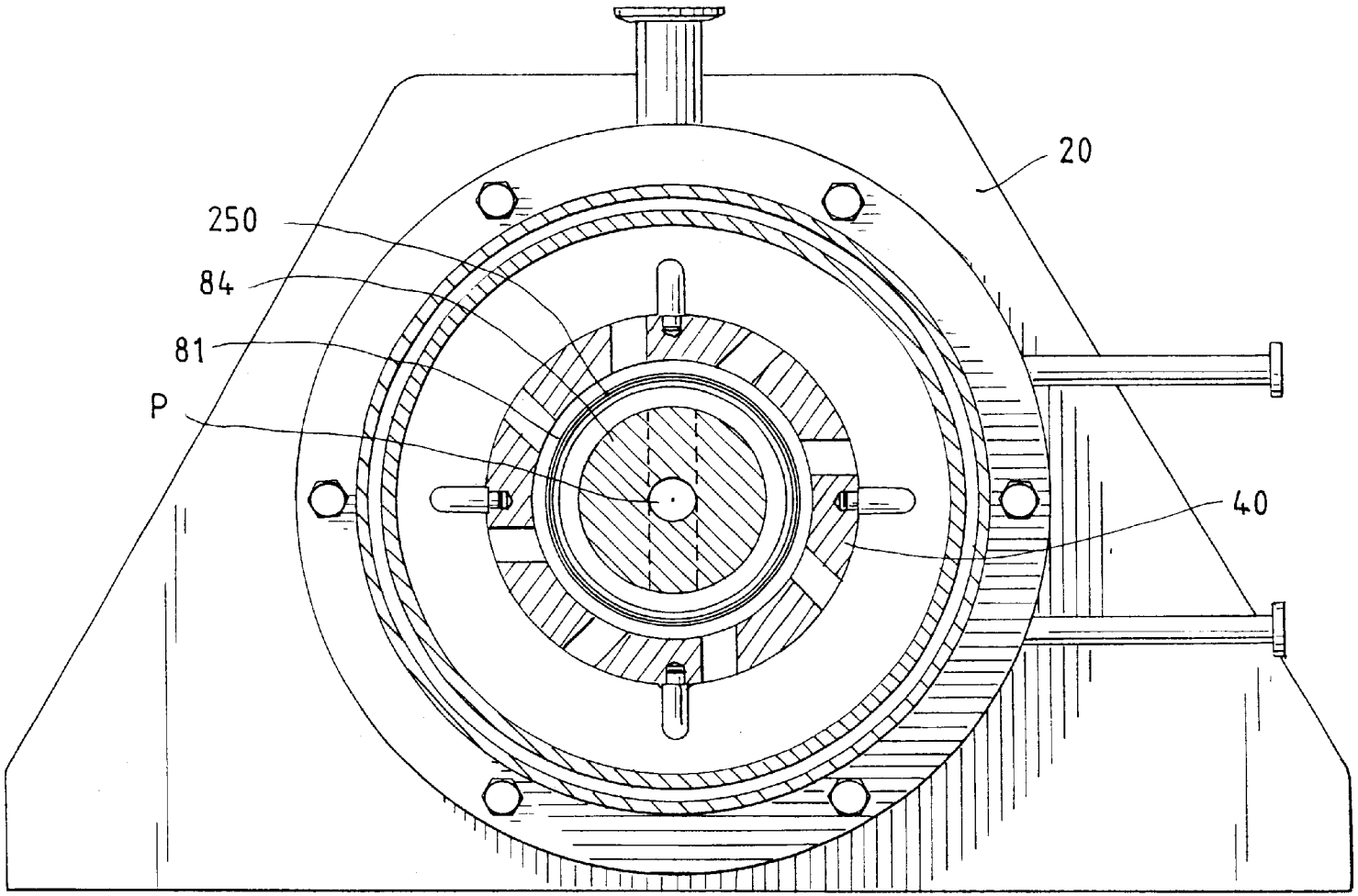
FIG. 4 is a cross-sectional view of the media mill taken along line 4—4 of FIG. 3, illustrating four rows of pegs and eight passages.

As seen in FIG. 3, the product outlet housing 82 extends within the milling chamber 110 into an enlarged bore formed in an end of the agitator shaft 41 and is supported in cantilever fashion in an opening 65 formed in the second annular mounting flange 64. Referring additionally to FIG. 4, which is a cross-section taken along the plane defined by line 4—4 in FIG. 3, the filter assembly includes a filter screen 81 in a cylindrical configuration disposed on the generally cylindrical product outlet housing 82. The product outlet housing includes an axially extending discharge passage P in fluid communication with a cross passage 84. Secured to the product outlet housing 82 via threaded fasteners, for example, is a filter retaining flange 86 for securing the filter screen 81 in place. The product outlet housing 82 extends within an enlarged bore of the agitator 40 and remains stationary as the agitator 40 rotates. The filter screen 81 functions to separate the milled product from the milling media. Specifically, the dispersion of product and milling media flows into the enlarged bore of the agitator shaft 41 through an annular passage 250 defined between the enlarged bore of the agitator shaft 41 and the external surface of the product outlet housing 82. Milled product of a sufficient grade passes through the filter screen 81, cross bore 84 and out of discharge passage P. Product and milling media that is not of sufficient grade to pass through filter 81 is centrifuged, by the motion of agitator 40 outward via slots formed in the agitator 40 and back to the exterior of the agitator 40 for further milling.

Figure 11:
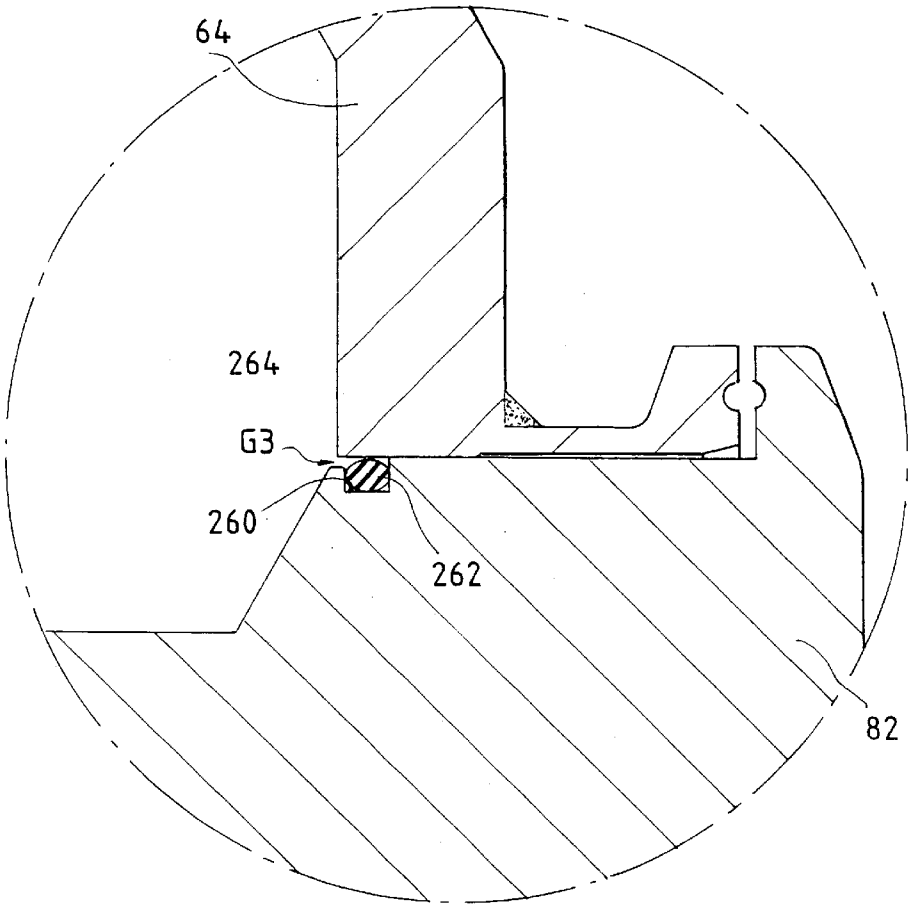
FIG. 11 is a magnified view showing the sanitary sealing interface between the product outlet housing and the mill chamber wall of FIG. 3.

The invention also provides a sanitary sealing interface between the product outlet housing 82 and the milling chamber housing 60. Referring to FIG. 11, the product outlet housing 82 is provided with an annular O-ring channel 260 which accomodates an O-ring 262 for sealing against an interior surface 264 of the second mounting flange 64. As is the case with the other sanitary interfaces, a gap (G3) is provided to expose a portion of the O-ring surface for improved cleanability and contamination prevention.

Figure 12:
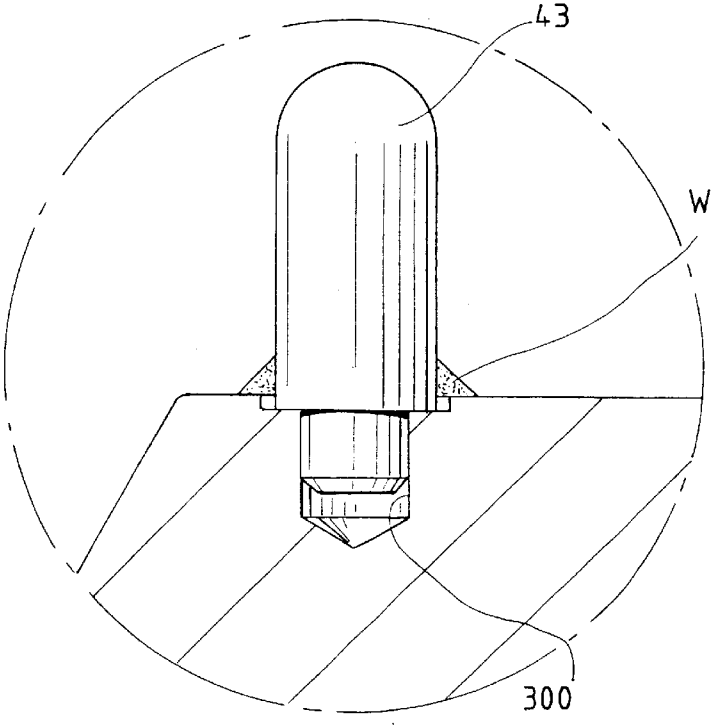
FIG. 12 is a magnified view showing the sanitary peg fastening features according to a preferred embodiment of the invention.

In accordance with a primary feature of the invention, the agitator 40 is provided with a smooth, seamless agitating surface. As used herein, the term "agitating surface" refers to the area of the agitator 40 that is substantially exposed to the dispersion in the milling chamber 110. The agitator 40 is preferably formed of surgical grade stainless steel. In the exemplary embodiment illustrated in FIGS. 3 and 4, the agitator has a plurality of shear members or pegs 43. Specifically, the agitator has four rows of pegs 43 at 90-degree locations about the agitator shaft 41. The agitator also includes eight slots S for causing, as the agitator rotates in a counterclockwise direction in FIG. 4, centrifugal action on the milling media and product located in the enlarged bore of the agitator 40 during milling. This centrifugal action results in the movement of milling media and product that is not of sufficiently small particulate size out of the enlarged bore of the agitator and back into the annular space between the agitator and the milling chamber for further grinding. The pegs 43 are permanently secured to the agitator shaft 41 by welds, which are machined and/or polished to provide a seamless joint. Referring to FIG. 12, each peg 43 can be inserted in a hole 300 formed in the agitator 41 and which may include threaded fasteners. The pegs 43 are then welded to permanently fix them to the agitator 41. The welds are ground and polished to remove any crevices and irregular surfaces which might harbor bacterial growth or make cleaning difficult. The invention also contemplates the use of sanitary sealing interfaces incorporating O-rings as described above for fastening the pegs 43 to the agitator shaft 41. Preferably, the agitator 40 is polished to have an average surface roughness of substantially no more than 15 micro-inches. Thus, agitator 40 is provided with a smooth, seamless agitating surface which achieves the advantages of the invention.

Figure 5A:
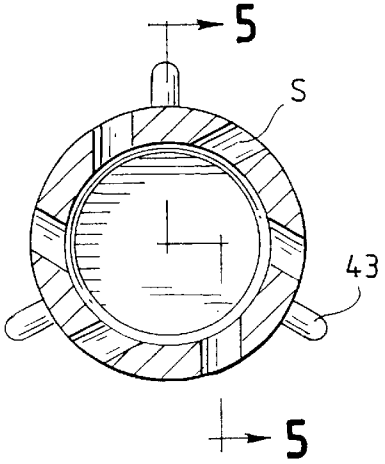
FIG. 5A is a cross-sectional view taken along line 5A—5A of FIG. 5, illustrating the three rows of pegs and the 6 passages.
Figure 5:
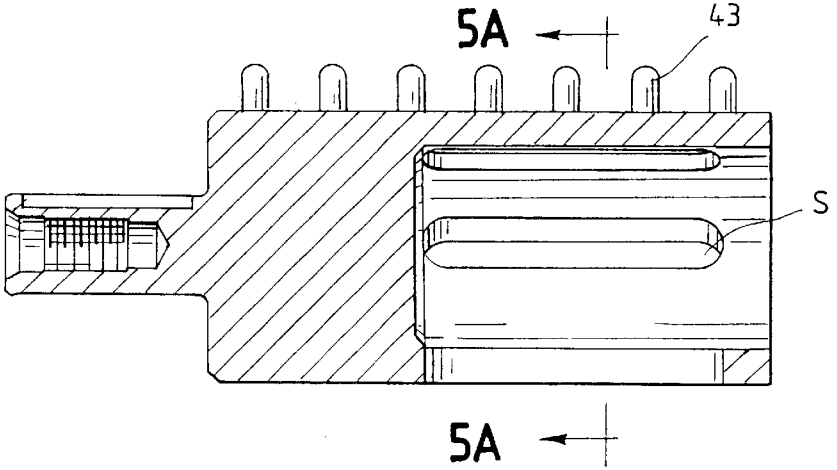
FIG. 5 illustrates another embodiment of the pegged agitator shown in FIG. 1, having three rows pegs and six passages.
Figure 5B:
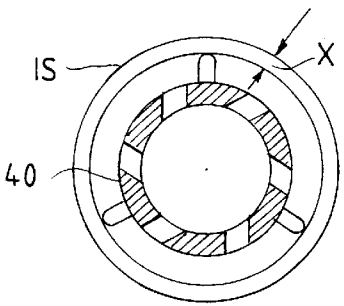
FIG. 5B illustrates the embodiment of FIG. 5A with an imaginary outer circumference of the pegs in phantom and an inner diameter of the vessel.

The invention contemplates other agitator configurations, as exemplified by FIGS. 5, 5A and 5B. Here, three rows of pegs 43, at 120-degree locations about the agitator shaft, and six slots are provided. Applicants have found that an annular clearance between the radial extent of pegs 43 and the inner surface IS of the milling chamber 110 of no greater than 5 mm yields desirable and advantageous results for particular mill configurations. However, the invention is not intended to be limited to mills with such specific clearances. For example, referring to FIG. 5B, the annular clearance between the radial extent of pegs 43 and the internal surface of the milling chamber 110 may be 9 mm. Also, as a general rule, the annular clearance is no less than six times the diameter is of the milling media being used.

Figure 6A:
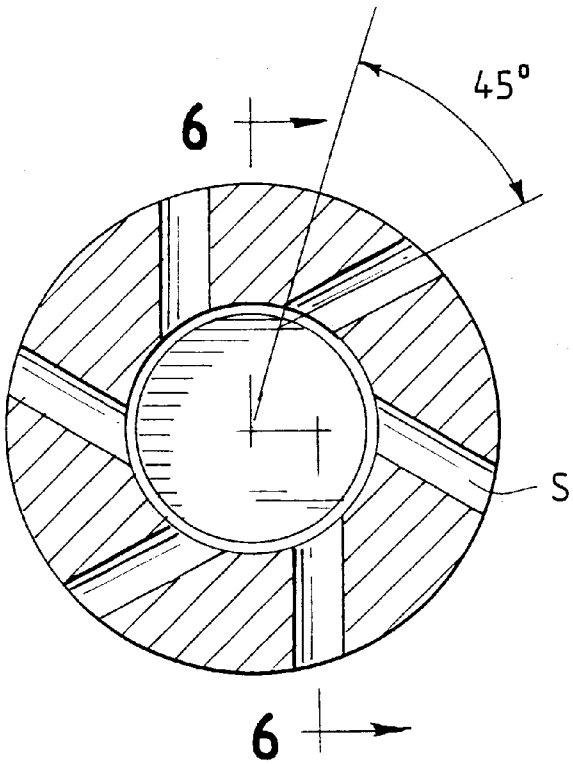
FIG. 6A is a cross-sectional view of the pegless agitator taken along line 6A—6A of FIG. 6, illustrating eight passages.
Figure 6:
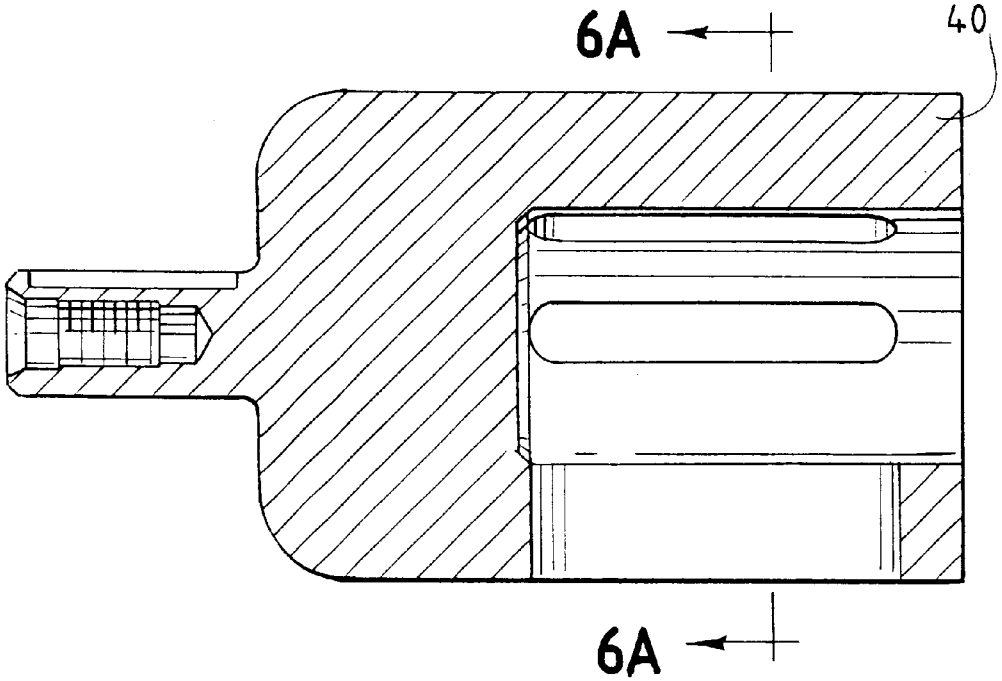
FIG. 6 illustrates a cross-sectional view of a pegless agitator taken along line 6—6 of FIG. 6A according to another aspect of the present invention that can be used in the media mill of FIG. 1.
Figure 10:
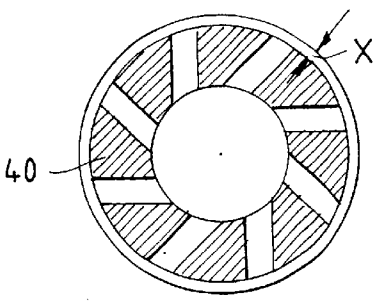
FIG. 10 is a cross-sectional view of another embodiment of a pegless agitator having eight passages.
Figure 9:
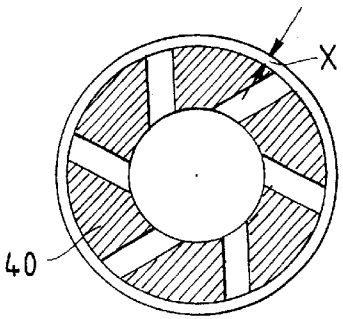
FIG. 9 is a cross-sectional view of another embodiment of a pegless agitator similar to the embodiment of FIG. 7, but having a smaller annular clearance with the mill housing wall.
Figure 8:
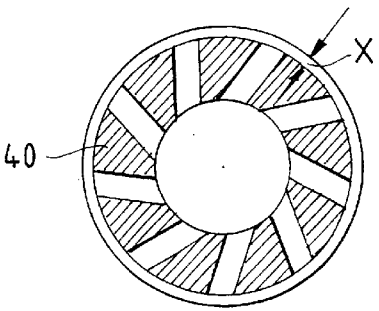
FIG. 8 is a cross-sectional view of another embodiment of a pegless agitator similar to the embodiment of FIG. 6, having nine passages.
Figure 7:
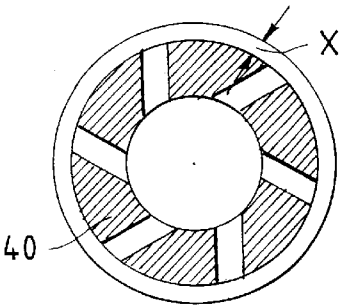
FIG. 7 is a cross-sectional view of another embodiment of a pegless agitator similar to the embodiment of FIG. 6, having six passages.

FIGS. 6–10 illustrate exemplary agitators 40 in accordance with another primary feature of the invention. In these embodiments, the agitator 40 is provided without pegs or shear members 43. Instead, the diameter of the agitator 40 has been enlarged to provide an annular clearance with the inner surface IS of the milling chamber 110 which results in desirable milling properties. FIGS. 6 and 6A illustrate an agitator 40 having eight slots (S) extending at a 45-degree angle to the agitator radius. FIG. 7 illustrates an agitator 40 having six slots. FIG. 8 illustrates an agitator 40 having 9 slots. FIG. 9 illustrates an agitator 40 having six slots and having a reduced annular clearance compared to the agitator of FIG. 7. FIG. 10 illustrates an agitator 40 having eight slots. As will be recognized by those of ordinary skill, particular structural features of agitators according to the invention, such as the number of slots, slot angle relative to agitator radius, and annular clearance, may be selected for particular mill configurations and milling media geometries to achieve desirable results.

Applicants have discovered several advantages provided by the cylindrical, pegless agitator according to the invention. The increase in diameter of the agitator 40 provides an increased moment of inertia and a flywheel effect, which, in combination with the smooth agitating surface, provides improved milling characteristics and speed stability during the milling process. The increase in diameter also increases the centrifugal forces on the milling media and product. The cylindrical, pegless agitators according to the invention are also easy and economical to manufacture with sanitary surfaces, since the outer cylindrical surface of the agitator may be easily polished to an appropriate finish.

Those of ordinary skill will recognize that a number of different metals may be used to construct the agitator and other components of the milling chamber according to the invention. The components having an exposure to the dispersion, including the agitator and interior milling chamber components are preferably made of 316L stainless steel.

In accordance with another aspect of the invention, the smooth, seamless agitators are used in combination with polymeric milling media. U.S. Pat. No. 5,4145,786 issued to Liversidge, et al.; U.S. Pat. No. 5,518,187 issued to Bruno, et al.; and U.S. Pat. No. 5,718,388 and U.S. Pat. No. 5,862,999 issued to Czekai, et al. disclose milling pharmaceutical products using polymeric milling media. The subject matter and entire writing of these patents is incorporated herein by reference. Preferably, The largest milling media should be nominally sized no greater than 500 microns (0.5 mm). Presently, the smallest milling media contemplated is about 50 microns. Applicants have discovered that favorable milling characteristics are achieved when the clearance between the radial extent of the agitator, whether a pegged embodiment or a pegless embodiment, and the interior surface of the milling chamber is approximately 6 times the diameter of the milling media used.

In general, the contamination levels achieved with the invention are less than 10 ppm for mill construction materials, i.e., stainless steel components such as iron, molybdenum, chromium and nickel relative the active pharmaceutical ingredient. Moreover, contamination levels for polystyrene, or other polymeric compounds when used as a milling media, are less than 1000 ppm relative to the active pharmaceutical ingredient. This represents an improvement over prior art milling systems, which typically provide contamination levels for milling media of no less than 1000 ppm relative to the active pharmaceutical ingredient.

It will be readily apparent from the foregoing detailed description of the invention and from the illustrations thereof that numerous variations and modifications may be effected without departing from the true spirit and scope of the novel concepts or principles of this invention, the scope of which is defined in the appended claims. For example, while pegged agitator geometries have been used to exemplify the invention, those of ordinary skill in the art will recognize that the salient aspects of the invention are also applicable to agitator geometries that utilize discs or cylindrical rotors, both in horizontal or vertical mill configurations.

What is claimed is:

1. A milling apparatus for the preparation of pharmaceutical grade milled product, the milling apparatus comprising:

a milling chamber housing defining a milling chamber adapted to contain a dispersion of the product and milling media; and an agitator rotatably mounted within the milling chamber for agitating the dispersion and thereby causing interaction between the milling media and the product to reduce the particulate size of the product, the agitator including an agitator shaft and having an agitating surface defined by the area of substantial exposure of the agitator to the dispersion, the agitating surface being substantially smooth and seamless to prevent the accumulation of contamination thereon and provide for cleaning in place of the agitator.

2. The milling apparatus of claim 1 wherein the agitator includes at least one shear member extending from the agitating shaft, the agitating surface being partially defined by an external surface of the at least one shear member.

3. The milling apparatus of claim 2 wherein the at least one shear member is permanently affixed to the agitator shaft.

4. The milling apparatus of claim 3 wherein the at least one shear member is affixed to the agitator shaft by a smooth weld.

5. The milling apparatus of claim 1 wherein the agitator shaft is cylindrical and substantially free of shear members extending therefrom, the agitating surface being defined exclusively by the exterior surface of the agitator shaft.

6. The milling apparatus of claim 1, wherein the average surface roughness of the agitating surface is substantially no more than 15 micro-inches.

7. The milling apparatus of claim 6, wherein the milling media comprises polymeric media.

8. The milling apparatus of claim 4, wherein the average surface roughness of the agitating surface is substantially no more than 15 micro-inches.

9. The milling apparatus of claim 8, wherein the milling media comprises polymeric media.

10. The milling apparatus of claim 5, wherein the average surface roughness of the agitating surface is substantially no more than 15 micro-inches.

11. The milling apparatus of claim 10, wherein the milling media comprises polymeric media.

12. An agitator for a wet milling apparatus for the preparation of pharmaceutical grade milled product, the agitator comprising an substantially smooth agitator shaft being substantially free of seams and crevices on an agitating surface thereof.

13. The agitator of claim 12 further comprising at least one shear member extending from the agitating shaft, the agitating surface being partially defined by an external surface of the at least one shear member.

14. The agitator of claim 13 wherein the at least one shear member is permanently affixed to the agitator shaft.

15. The agitator of claim 14 wherein the at least one shear member is affixed to the agitator shaft by a smooth weld.

16. The agitator of claim 12 wherein the agitator shaft is cylindrical and substantially free of shear members extending therefrom, agitating surface being defined exclusively by the exterior surface of the agitator shaft.

17. The agitator of claim 1 wherein the average surface roughness of the agitating surface is substantially no more than 15 micro-inches.

18. A milling apparatus for the preparation of pharmaceutical grade milled product, the milling apparatus comprising:

a milling chamber housing defining a milling chamber adapted to contain a dispersion of the product and milling media;

an agitator rotatably mounted within the milling chamber for agitating the dispersion and thereby causing interaction between the milling media and the product to reduce the particulate size of the product;

a product outlet housing including a media separation screen for separating milled product from the milling media;

a sanitary fastener for securing the product outlet housing within the milling chamber, the sanitary fastener being a threadless fastener without seams or crevices.

19. A milling apparatus for the preparation of pharmaceutical grade milled product, the milling apparatus comprising:

a milling chamber housing defining a milling chamber adapted to a dispersion of the product and milling media;

an agitator rotatably mounted within the milling chamber for agitating the dispersion and thereby causing interaction between the milling media and the product to reduce the particulate size of the product;

the milling chamber being of a substantially seamless construction to prevent contamination thereof.

* * * * *